US010668719B2

(12) United States Patent
Sakurai et al.

(10) Patent No.: US 10,668,719 B2
(45) Date of Patent: Jun. 2, 2020

(54) RECORDING ELEMENT SUBSTRATE, LIQUID EJECTION HEAD, AND LIQUID EJECTION APPARATUS

(71) Applicant: CANON KABUSHIKI KAISHA, Tokyo (JP)

(72) Inventors: Masataka Sakurai, Kawasaki (JP); Nobuyuki Hirayama, Fujisawa (JP); Ryo Kasai, Tokyo (JP); Kengo Umeda, Tokyo (JP); Hidenori Yamato, Tokyo (JP); Masanobu Ohmura, Yokohama (JP); Tatsuhito Goden, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/138,638

(22) Filed: Sep. 21, 2018

(65) Prior Publication Data

US 2019/0023007 A1 Jan. 24, 2019

Related U.S. Application Data

(63) Continuation of application No. 15/601,848, filed on May 22, 2017, now Pat. No. 10,105,949.

(30) Foreign Application Priority Data

May 30, 2016 (JP) ..... 2016-107440

(51) Int. Cl.
*B41J 2/14* (2006.01)
*B41J 2/045* (2006.01)
(Continued)

(52) U.S. Cl.
CPC ..... *B41J 2/04541* (2013.01); *B41J 2/14032* (2013.01); *B41J 2/14072* (2013.01);
(Continued)

(58) Field of Classification Search
CPC ..... B41J 2/04541; B41J 2/14032; B41J 2/14072; B41J 2002/14459; B41J 2202/12; B41J 2/01; B41J 2/05; B41J 2/33535
See application file for complete search history.

(56) References Cited

U.S. PATENT DOCUMENTS 5,208,605 A 5/1993 Drake
6,916,090 B2 7/2005 Valley et al.
(Continued)

FOREIGN PATENT DOCUMENTS

CN 1654215 A 8/2005
CN 1982066 A 6/2007
(Continued)

*Primary Examiner* — Yaovi M Ameh
(74) *Attorney, Agent, or Firm* — Canon U.S.A. Inc., IP Division

(57) ABSTRACT

A recording element substrate includes a substrate, a plurality of energy generating elements arranged on the substrate to form an element row, a plurality of supply ports arranged along the element row to form a supply port row, and a plurality of supply paths extending from the plurality of supply ports along the thickness direction of the substrate, wherein a plurality of beam portions disposed between adjacent supply ports in the direction of the supply port row has a plurality of conductor layers in which a conductor layer including a power supply conductor connected to the energy generating elements and a conductor layer including a ground conductor connected to the energy generating elements, are stacked along the thickness direction of the substrate, and wherein at least one of the plurality of conductor layers is occupied by one power supply conductor or one ground conductor.

13 Claims, 6 Drawing Sheets

(51) Int. Cl.

| | |
|---|---|
| *B41J 2/01* | (2006.01) |
| *B41J 2/105* | (2006.01) |
| *B41J 2/335* | (2006.01) |

(52) U.S. Cl.

CPC ..... *B41J 2/01* (2013.01); *B41J 2/105* (2013.01); *B41J 2/33535* (2013.01); *B41J 2002/14459* (2013.01); *B41J 2202/12* (2013.01)

(56) References Cited

U.S. PATENT DOCUMENTS

| | | | | |
|---|---|---|---|---|
| 2010/0066787 | A1* | 3/2010 | Yokouchi | B41J 2/14233 347/47 |
| 2012/0056940 | A1* | 3/2012 | Sakurai | B41J 2/14145 347/54 |
| 2012/0069101 | A1* | 3/2012 | Kato | B41J 2/14233 347/70 |

FOREIGN PATENT DOCUMENTS

| | | | |
|---|---|---|---|
| CN | 101269575 | A | 9/2008 |
| CN | 102307732 | A | 1/2012 |
| JP | 2010-179608 | A | 8/2010 |
| JP | 2014-210373 | A | 11/2014 |
| JP | 2015-096318 | A | 5/2015 |
| JP | 2015-157444 | A | 9/2015 |

* cited by examiner

RECORDING ELEMENT SUBSTRATE, LIQUID EJECTION HEAD, AND LIQUID EJECTION APPARATUS

CROSS-REFERENCE TO RELATED APPLICATIONS

This application is a continuation, and claims the benefit, of U.S. patent application Ser. No. 15/601,848, presently pending and filed on May 22, 2017, and claims the benefit of, and priority to, Japanese Patent Application No. 2016-107440 filed May 30, 2016, which applications are hereby incorporated by reference herein in their entireties.

BACKGROUND OF THE INVENTION

Field of the Invention

The present disclosure generally relates to a recording element substrate, a liquid ejection head, and a liquid ejection apparatus.

Description of the Related Art

In a liquid ejection apparatus, energy generating elements provided on a recording element substrate of a liquid ejection head are driven using a driving power supply and a control signal, and liquid is thereby ejected from ejection ports. The recording element substrate is provided with contact pads that receive a power supply and a control signal from the main body of the liquid ejection apparatus, and conductors that transmit the power supply and the control signal.

In such a liquid ejection apparatus, a plurality of energy generating elements are driven at the same time for high-speed recording. When a plurality of energy generating elements are driven at the same time, the current flowing through the conductors changes depending on the number of energy generating elements being driven at the same time, which changes the voltage applied to the energy generating elements. As a result, the amount and velocity of ejected liquid changes, and the quality of the recorded image may deteriorate.

In order to suppress the change of voltage applied to energy generating elements, it is possible to provide a different conductor for each of the plurality of energy generating elements driven at the same time. However, providing a different conductor for each energy generating element throughout the route from contact pads to energy generating elements is difficult because it causes an increase in the substrate area. For this reason, Japanese Patent Laid-Open No. 10-44416 discloses a recording element substrate having a conductor that is shared by a plurality of energy generating elements in the vicinity of a contact pad and that branches toward the energy generating elements.

However, in the configuration disclosed in Japanese Patent Laid-Open No. 10-44416, a supply port that is common to and supplies liquid to a plurality of energy generating elements arranged on the same straight line is provided in a rectangular shape that opens continuously. However this causes the substrate area to increase significantly with an increase in the number of energy generating elements driven at the same time. A row formed by a plurality of energy generating elements arranged on the same straight line will hereinafter be referred to as an element row.

FIG. 5 shows a recording element substrate 900 that is a recording element substrate having the configuration disclosed in Japanese Patent Laid-Open No. 10-44416 and that has an increased number of energy generating elements per element row and an increased number of element rows. The recording element substrate 900 has a substrate 901, element rows 902 in which a plurality of energy generating elements are arranged on a straight line, and supply ports 903 that are provided in correspondence to the element rows 902 and that supply liquid to energy generating elements included in the corresponding element rows 902. The supply ports 903 are each disposed between two element rows 902, and have a rectangular shape extending parallel to a direction in which the element rows 902 extend. Since the element rows 902 are separated from each other by the supply ports 903, power supply conductors 904*a* and ground conductors 904*b* connected to the element rows 902 are provided for each element row 902. Electrode pads 905 for connecting the power supply conductors 904*a* and the ground conductors 904*b* to the outside are provided at ends of the substrate 901 in a direction in which the element rows 902 extends, and on the outer side of the ends of the element rows 902.

As shown in FIG. 5, increasing the number of energy generating elements for high-definition recording and increasing the number of the energy generating elements driven at the same time to improve the recording speed increases the substrate area. In particular, in the case of the recording element substrate 900 of FIG. 5, since the power supply conductors 904*a* and the ground conductors 904*b* are separated from each other by the supply ports 903, if the number of element rows 902 is increased, the number of power supply conductors 904*a* and the number of ground conductors 904*b* need to be increased correspondingly. For this reason, the substrate area increases significantly, the yield per wafer decreases, and the cost per recording element substrate increases.

In order to avoid the increase in the substrate area, it is possible to reduce the width of the conductors. However, in this case, the wiring resistance increases, and the power efficiency when driving the energy generating elements decreases.

SUMMARY OF THE INVENTION

Accordingly, the present disclosure provides a recording element substrate in which the decrease in the power efficiency when driving energy generating elements can be suppressed while avoiding the increase in the substrate area accompanying the increase in the number of energy generating elements driven at the same time.

In an aspect of the present invention, a recording element substrate includes a substrate, a plurality of energy generating elements arranged on the substrate to form an element row, a plurality of supply ports, supplying liquid to the energy generating elements, arranged along the element row to form a supply port row, and a plurality of supply paths extending from the plurality of supply ports along the thickness direction of the substrate, wherein a plurality of beam portions disposed between adjacent supply ports in the direction of the supply port row has a plurality of conductor layers in which a conductor layer including a power supply conductor connected to the energy generating elements and a conductor layer including a ground conductor connected to the energy generating elements, are stacked along the thickness direction of the substrate, and wherein at least one of the plurality of conductor layers is occupied by one power supply conductor or one ground conductor.

Further features of the present disclosure will become apparent from the following description of exemplary embodiments with reference to the attached drawings.

DESCRIPTION OF THE EMBODIMENTS

Figure 1A:
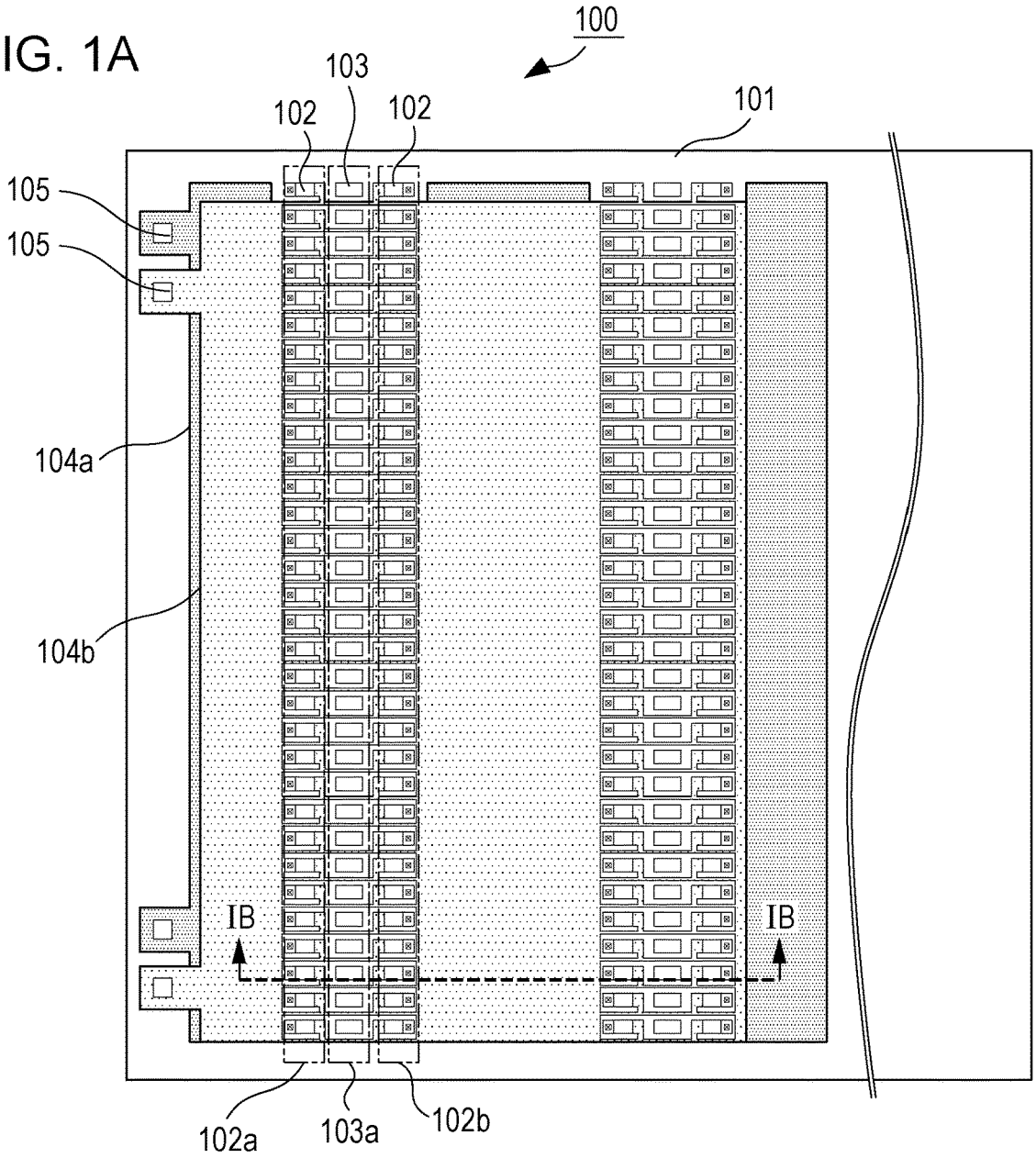
FIGS. 1A to 1D illustrate a first embodiment of the present disclosure.

Embodiments of the present disclosure will now be described with reference to the drawings. In this specification and drawings, components having the same function are given the same reference numerals, and redundant description thereof may be omitted.

First Embodiment

Figure 1B:
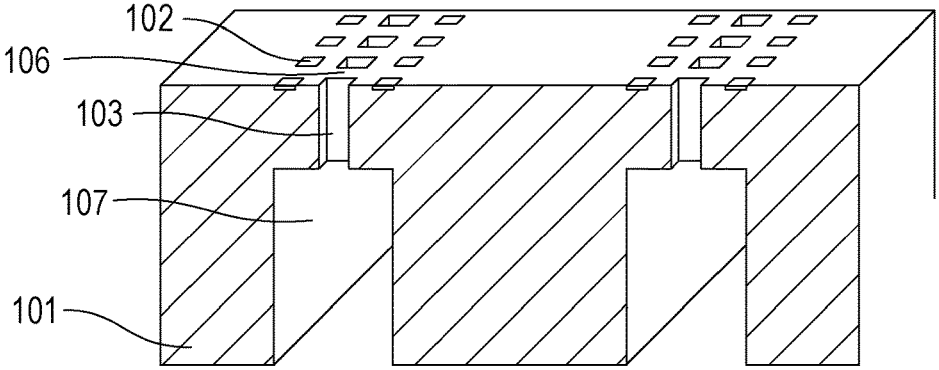

FIGS. 1A to 1D show a first embodiment of the present disclosure. FIG. 1A schematically shows the substrate layout of a recording element substrate according to the first embodiment of the present disclosure. FIG. 1B is a sectional perspective view of the recording element substrate of FIG. 1A taken along line IB-IB of FIG. 1A.

The recording element substrate 100 has a substrate 101, energy generating elements 102, individual supply paths 103, power supply conductors 104*a*, ground conductors 104*b*, electrode pads 105, and common supply paths 107.

The energy generating elements 102 are elements that generate energy for ejecting liquid. The energy generating elements 102 may be any of various types of elements proposed in liquid ejection technology, and are, for example, elements that convert electric energy into heat energy or mechanical energy. The plurality of energy generating elements 102 are arranged linearly on the substrate 101, and form element rows 102*a* and 102*b*.

The individual supply paths 103 are flow paths that are provided in correspondence to the energy generating elements 102 and that supply liquid to the corresponding energy generating elements 102. The individual supply paths 103 are flow paths extending along the thickness direction of the substrate 101, and communicate with the common supply paths 107. On a surface of the substrate 101 on which the energy generating elements 102 are provided, supply ports that are openings of the individual supply paths 103 are arranged on straight lines substantially parallel to the element rows 102*a*, and form supply port rows 103*a*. In other words, the individual supply paths 103 are flow paths that extend from the supply ports along the thickness direction of the substrate 101. In the example of FIG. 1A, one individual supply path 103 is formed in correspondence to two energy generating elements 102. That is, the first element row 102*a* and the second element row 102*b* are each provided along the supply port row, the first element row 102*a* is provided on one side of the supply port row 103*a*, and the second element row 102*b* is provided on the other side of the supply port row 103*a*. The supply ports included in the supply port row 103*a* supply liquid to energy generating elements 102 included in the first element row 102*a* and energy generating elements 102 included in the second element row 102*b*.

The power supply conductor 104*a* and the ground conductor 104*b* are connected to the energy generating elements 102 and the electrode pads 105 and supply a signal to the electrode pads 105 and to the energy generating elements 102. The power supply wiring and the ground wiring are multilayer structures in which a plurality of conductor layers are stacked along the thickness direction of the substrate 101. In FIGS. 1A and 1B, the ground conductor 104*b* is formed in a conductor layer on the front surface side of the substrate 101, and the power supply conductor 104*a* is formed in a conductor layer located nearer to the back surface of the substrate 101 than the conductor layer of the ground conductor 104*b*. Although only the power supply conductor 104*a* and the ground conductor 104*b* are shown in FIG. 1A for simplicity, the multilayer wiring structure actually includes signal conductors of a selection circuit and a drive circuit (not shown). In the example of FIG. 1A, the power supply conductor 104*a* and the ground conductor 104*b* are each connected to all of the energy generating elements 102, and form a common wiring structure.

The electrode pads 105 are contact portions that receive a power supply and a control signal from the outside. In the example of FIG. 1A, the electrode pads 105 are provided at an end of the substrate 101 in a direction intersecting with (perpendicular to) a direction in which the element rows 102*a* and the supply port row 103*a* extend. The power supply and control signal supplied to the electrode pads 105 are supplied to the energy generating elements 102 through various conductors provided in the multilayer wiring. In this embodiment, the electrode pads 105 are all disposed at one end of the substrate 101, more specifically, along one side of the substrate 101 along the direction of the element rows 102*a*. The electrode pads 105 may also be provided on two opposing sides along the direction of the element rows 102*a*.

As shown in FIG. 1B, the common supply paths 107 are provided in a surface of the substrate 101 that is opposite to the surface on which the energy generating elements 102 are provided. The common supply path 107 extends in a direction in which the supply port row 103*a* extends, and communicates with a plurality of individual supply paths 103.

Figure 1C:
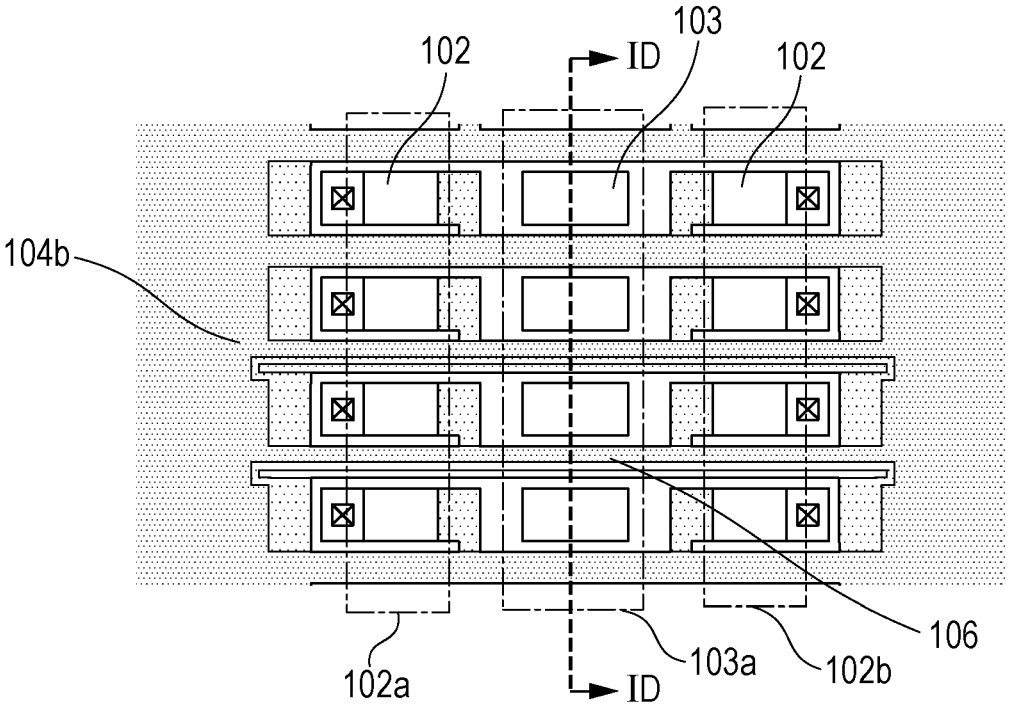
Figure 1D:
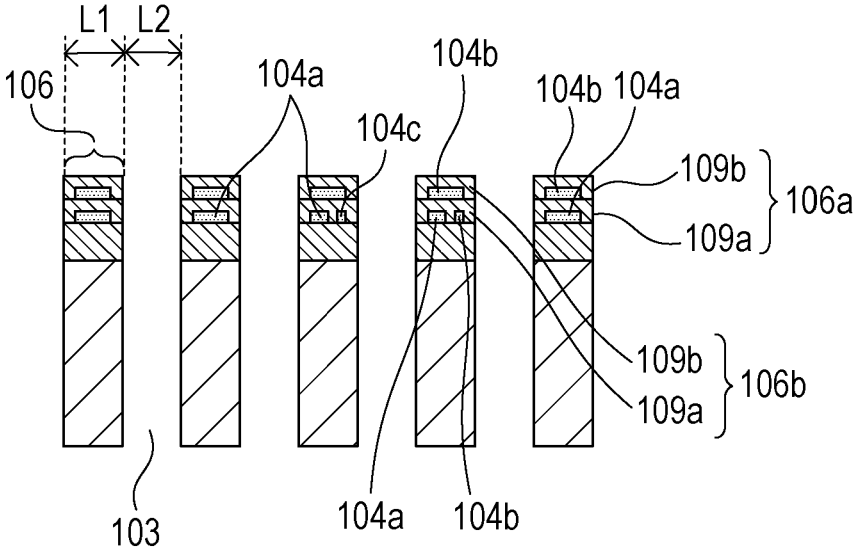

FIG. 1C is a partial enlarged view of the recording element substrate 100 of FIG. 1A. FIG. 1D is a sectional view taken along line ID-ID of FIG. 1C. The substrate 101 has beam portions 106 sandwiched between adjacent individual supply paths 103 in the supply port row 103*a*. Multilayer wiring structure is formed on the substrate 101 and passes through the beam portions 106. It has at least two conductor layers including a conductor layer 109*a* in which the power supply conductor 104*a* is formed and a conductor layer 109*b* in which the ground conductor 104*b* is formed. Each conductor layer may be occupied by one type of conductor, or a plurality of types of conductors may be included in one conductor layer. The energy generating elements 102 included in the first element row 102*a* and the energy generating elements 102 included in the second element row 102*ab* are connected through the power supply conductor 104*a* and the ground conductor 104*b* provided in the beam portions 106. Since conductors are provided in the beam portions 106, conductors can be provided in a direction from one end of the substrate 101, at which the electrode pads 105 are provided, toward the other end beyond the element rows 102*a* and 102*b* and the supply port row 103*a*, through the beam portions 106. For this reason, an electrode pad 105 need not be provided for each of the different element rows 102*a* and 102*b*, and all of the electrode pads 105 can be disposed at one end of the substrate 101.

The width L1 of the beam portions 106 has a trade-off relationship with the flow path width L2 of the individual supply paths 103. That is, if the flow path width L2 of the individual supply path 103 is reduced, the width L1 of the beam portions 106 can be increased, and therefore, the width of conductors provided in the beam portions 106 can be increased. However, if the flow path width L2 of the individual supply paths 103 is too small, it is difficult to supply liquid to the energy generating elements 102 efficiently. Because the individual supply paths 103 are formed, for example, by dry etching so as to penetrate from one surface of the substrate 101 to the other surface, if the flow path width L2 of the individual supply paths 103 is too small, a problem of workability arises. For this reason, the flow path width L2 of the individual supply paths 103 is preferably greater than or equal to a certain value. Since there is a lower limit to the flow path width L2 of the individual supply paths 103, it is difficult to increase the width L1 of the beam portions 106 when the length of the substrate 101 in the direction of the element rows 102*a* is fixed. When providing conductors in the beam portions 106, it is preferable to provide certain intervals between the conductors and the individual supply paths 103 taking into consideration of the working accuracy of the individual supply paths 103 and the conductors. If the width L1 of the beam portions 106 and the distance between the conductors passing through the beam portions 106 and the individual supply paths 103 are taken into consideration, the width of the conductors passing through the beam portions 106 decreases, and the wiring resistance thereof increases.

So, in this embodiment, at least one of the plurality of conductor layers of the beam portions 106 is occupied by one power supply conductor 104*a* or one ground conductor 104*b*.

In the example shown in FIG. 1D, a plurality of conductor layers forming a beam portion 106*a* include a conductor layer 109*a* that is occupied by a power supply conductor 104*a* and in which no other conductor is provided, and a conductor layer 109*b* that is occupied by a ground conductor 104*b* and in which no other conductor is provided. A plurality of conductor layers forming a beam portion 106*b* include a conductor layer 109*a* in which a power supply conductor 104*a*, and a conductor 104*c* different from the power supply conductor 104*a* and the ground conductor 104*b* are provided. The plurality of conductor layers forming the beam portion 106*b* further include a conductor layer 109*b* that is occupied by a ground conductor 104*b* and in which no other conductor is provided. At least part of the current supplied to a plurality of energy generating elements 102 driven at the same time flows through the power supply conductor 104*a* and the ground conductor 104*b* passing through the beam portions 106.

In the first embodiment of the present disclosure, a supply port row 103*a* is formed in correspondence to a plurality of element rows 102*a* and 102*b*. The supply port row 103*a* includes a plurality of supply ports that are openings of the individual supply paths 103. For this reason, beam portions 106 that are regions sandwiched between adjacent supply ports are formed on the substrate 101. Owing to the presence of the beam portions 106, conductors connecting different element rows 102*a* and 102*b* can be provided, and it is not necessary to provide different conductors in correspondence to different element rows 102*a* and 102*b*. That is, energy generating elements 102 of different element rows 102*a* and 102*b* can be connected to a common power supply conductor 104*a* and a common ground conductor 104*b* provided in a part other than the beam portions 106, through power supply conductors 104*a* and ground conductors 104*b* passing through the beam portions 106.

In the beam portions 106, in order to reduce the conductor resistance, in this embodiment, the conductor layers are stacked in a multilayer structure. At least one of the plurality of conductor layers of the beam portions 106 is occupied by one power supply conductor 104*a* or one ground conductor 104*b*. If more than one conductor is provided in a conductor layer, the conductors are disposed at intervals, and therefore the width of the conductors provided in the beam portions 106 decreases correspondingly and resistance increases. Therefore, at least one of the plurality of conductor layers forming the beam portions 106 is occupied by one conductor, so that the resistance of the conductors passing through the beam portions 106 can be reduced, and if a plurality of energy generating elements 102 are driven at the same time, the effect of voltage drop in the conductors can be suppressed. When a conductor layer is occupied by one conductor, the width of the conductor is preferably one-half or more of the width L1 of the beam portions 106. In order to further suppress the effect of voltage drop, the beam portions 106 preferably have a conductor layer occupied by a power supply conductor 104*a* and a conductor layer occupied by a ground conductor 104*b*.

A liquid ejection head having a plurality of recording element substrates 100 arranged in the direction of element rows 102 can also be formed. A liquid ejection apparatus that has a liquid ejection head and that drives energy generating elements 102 and ejects liquid can also be formed.

Second Embodiment

Figure 2A:
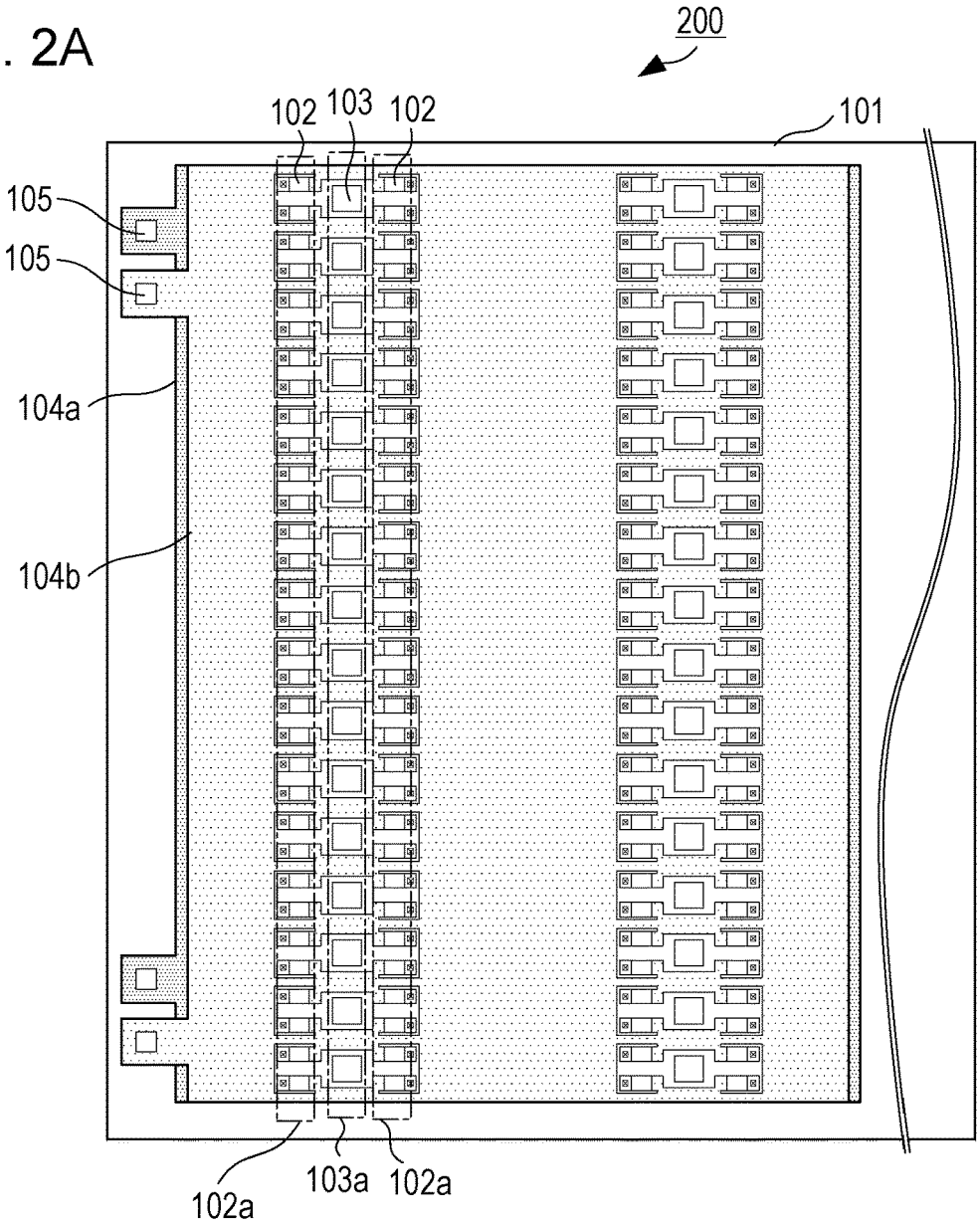
FIGS. 2A and 2B illustrate a second embodiment of the present disclosure.
Figure 2B:
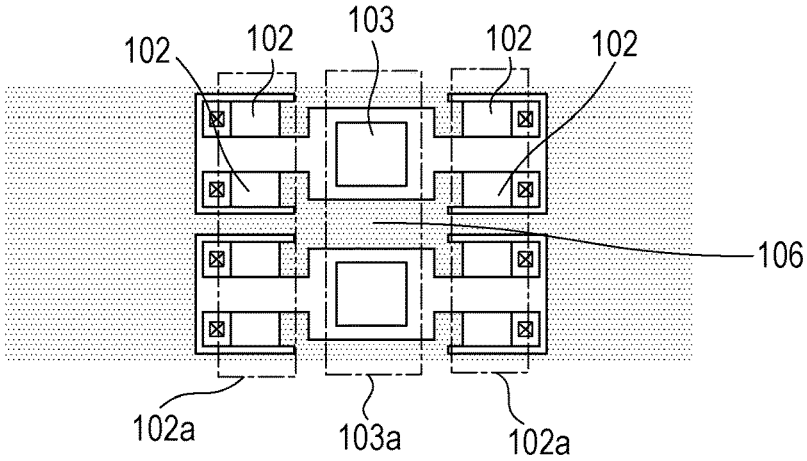

FIGS. 2A and 2B show a second embodiment of the present disclosure. FIG. 2A schematically shows the substrate layout of a recording element substrate 200 according to the second embodiment of the present disclosure. FIG. 2B is a partial enlarged view of the recording element substrate 200 of FIG. 2A.

The difference from the first embodiment will be mainly described. In the first embodiment, one individual supply path 103 is provided for two energy generating elements 102, whereas in the second embodiment, one individual supply path 103 is provided for four energy generating elements on both sides. Therefore, in this embodiment, the number of individual supply paths 103 included in one supply port row 103*a* is half of that in the first embodiment. The interval between adjacent energy generating elements 102 included in the element rows 102*a* is less than the interval between adjacent individual supply paths 103 included in the supply port row 103*a* provided in correspondence to the element rows 102*a*.

By virtue of such a configuration, although the number of beam portions 106 sandwiched between adjacent individual supply paths 103 is small, the width of the beam portions 106 can be increased. Therefore, the width of the conductors passing through the beam portions 106 can be increased, and the resistance of the conductors passing through the beam portions 106 can be further reduced. The configuration of the multilayer conductors provided in the beam portions 106 is the same as that described in the first embodiment, and it is preferable to make the width of the conductors as large as possible in accordance with the increase in the width of the beam portions 106.

Third Embodiment

Figure 3:
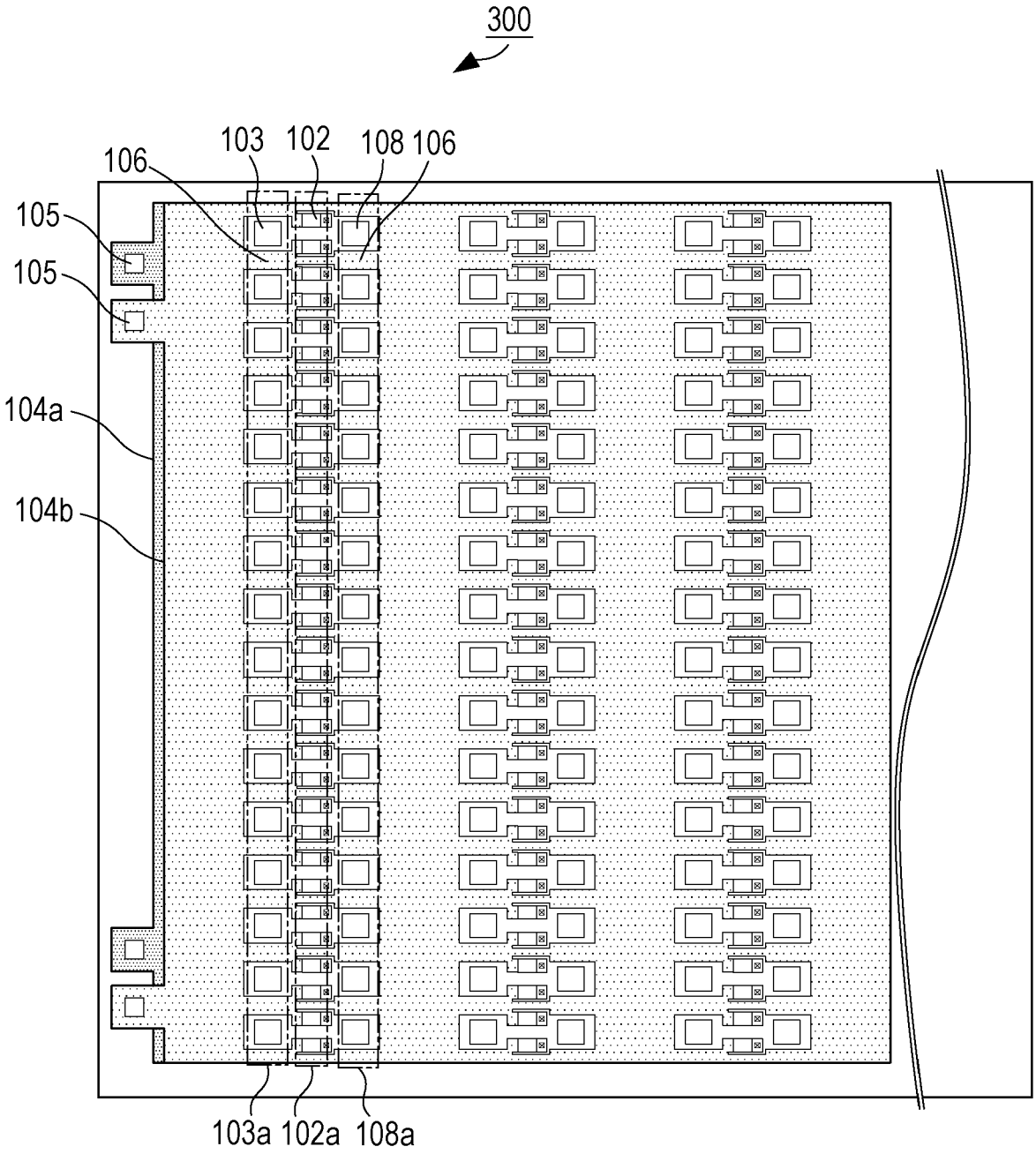
FIG. 3 illustrates a third embodiment of the present disclosure.

FIG. 3 shows a third embodiment of the present disclosure. FIG. 3 schematically shows the substrate layout of a recording element substrate 300 according to the third embodiment of the present disclosure. This embodiment is further provided with a plurality of individual discharge paths 108 that discharge part of liquid supplied from the individual supply paths 103 to the energy generating elements 102. The individual discharge paths 108 are, as with the individual supply paths 103, flow paths extending along the thickness direction of the substrate 101, and communicate with a common discharge path (not shown) having the same configuration as the common supply path 107. Discharge ports that are openings of the individual discharge paths 108 are arranged on the substrate 101 and form a discharge port row 108*a* corresponding to the element row 102*a*. In other words, the individual discharge paths 108 are flow paths that extend from the discharge ports along the thickness direction of the substrate 101. The supply port row 103*a* and the discharge port row 108*a* are disposed on both sides of the corresponding element row 102*a*.

By virtue of such a configuration, a liquid circulation path leading from the individual supply paths 103 via the energy generating elements 102 to the individual discharge paths 108 can be formed. By circulating the liquid, water in the liquid, in the vicinity of the energy generating elements 102, can be prevented from evaporating, and the viscosity of the liquid can be prevented from increasing. The recording element substrate 300 has pressure chambers that have therein energy generating elements 102 that generate energy used for ejecting liquid. A liquid ejection head having this recording element substrate 300 is configured to circulate liquid between the inside of the pressure chambers and the outside of the pressure chambers.

In such a circulation configuration, the number of flow paths provided for the element row 102*a* is large, and therefore the number of the beam portions 106 is also large. Therefore, the effect of conductor resistance in the beam portions 106 is significant. For this reason, conductors provided in the beam portions 106 are disposed in multiple layers as in the first embodiment. The conductor layers are occupied by a power supply conductor 104*a* or a ground conductor 104*b*, and conductor resistance can thereby be suppressed.

Fourth Embodiment

Figure 4:
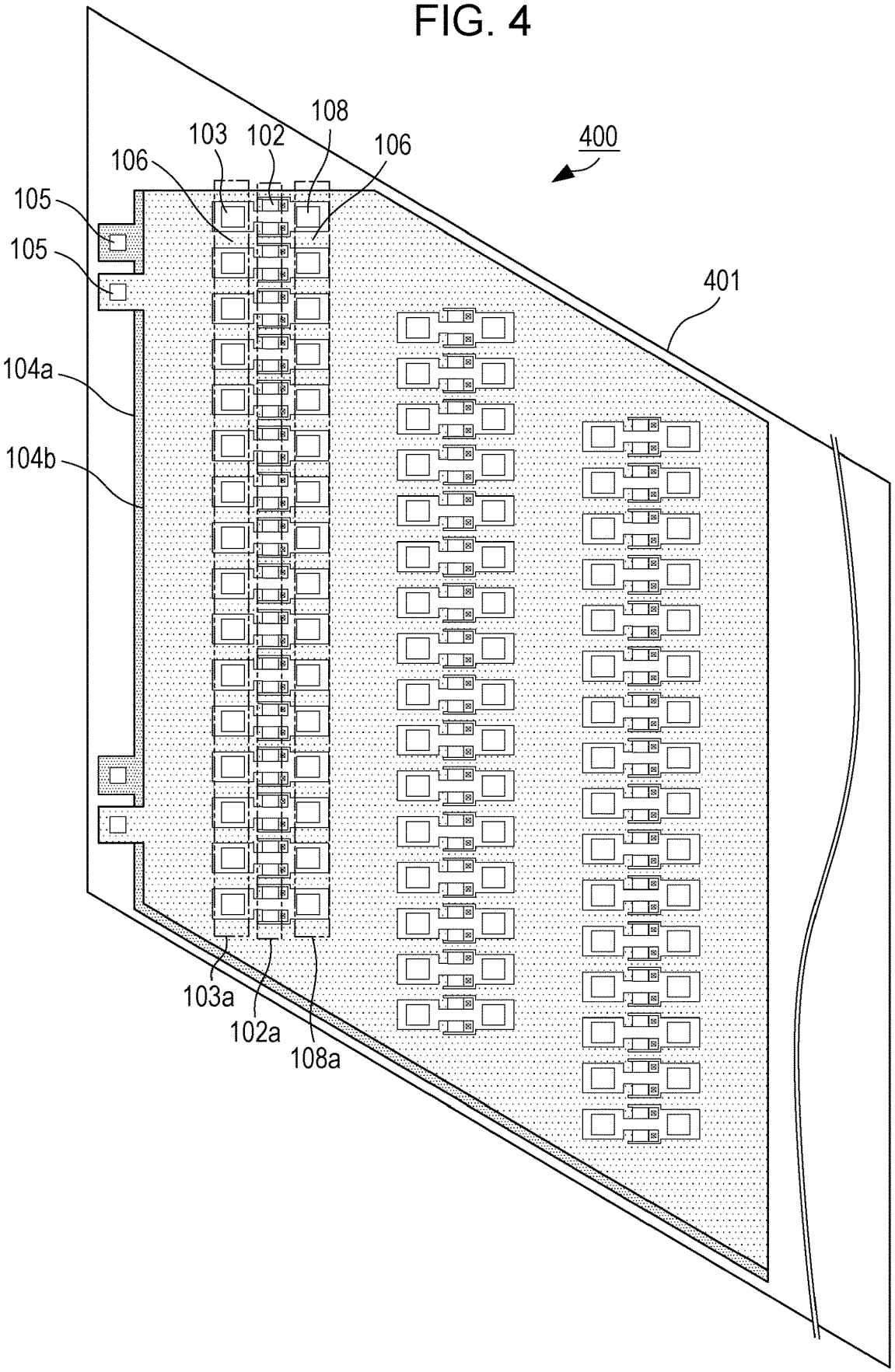
FIG. 4 illustrates a fourth embodiment of the present disclosure.

FIG. 4 shows a fourth embodiment of the present disclosure. FIG. 4 schematically shows the substrate layout of a recording element substrate 400 according to the fourth embodiment of the present disclosure. In this embodiment, adjacent sides of the substrate 401 are not at right angles to each other, and the substrate 401 is in the shape of a parallelogram. When forming a long head in which a plurality of substrates are arranged, it is preferable to dispose adjacent substrates close to each other to reduce the size. For this reason, in recent years, there has been proposed a configuration in which substrates have such a shape that adjacent sides are not at right angles to each other, such as a parallelogram or trapezoid, and the substrates are disposed closer to each other. Mutually separated individual supply paths 103 and multilayer conductors of beam portions 106 of the present disclosure can also be applied to the substrate 401 whose adjacent sides are not at right angles to each other.

Figure 5:
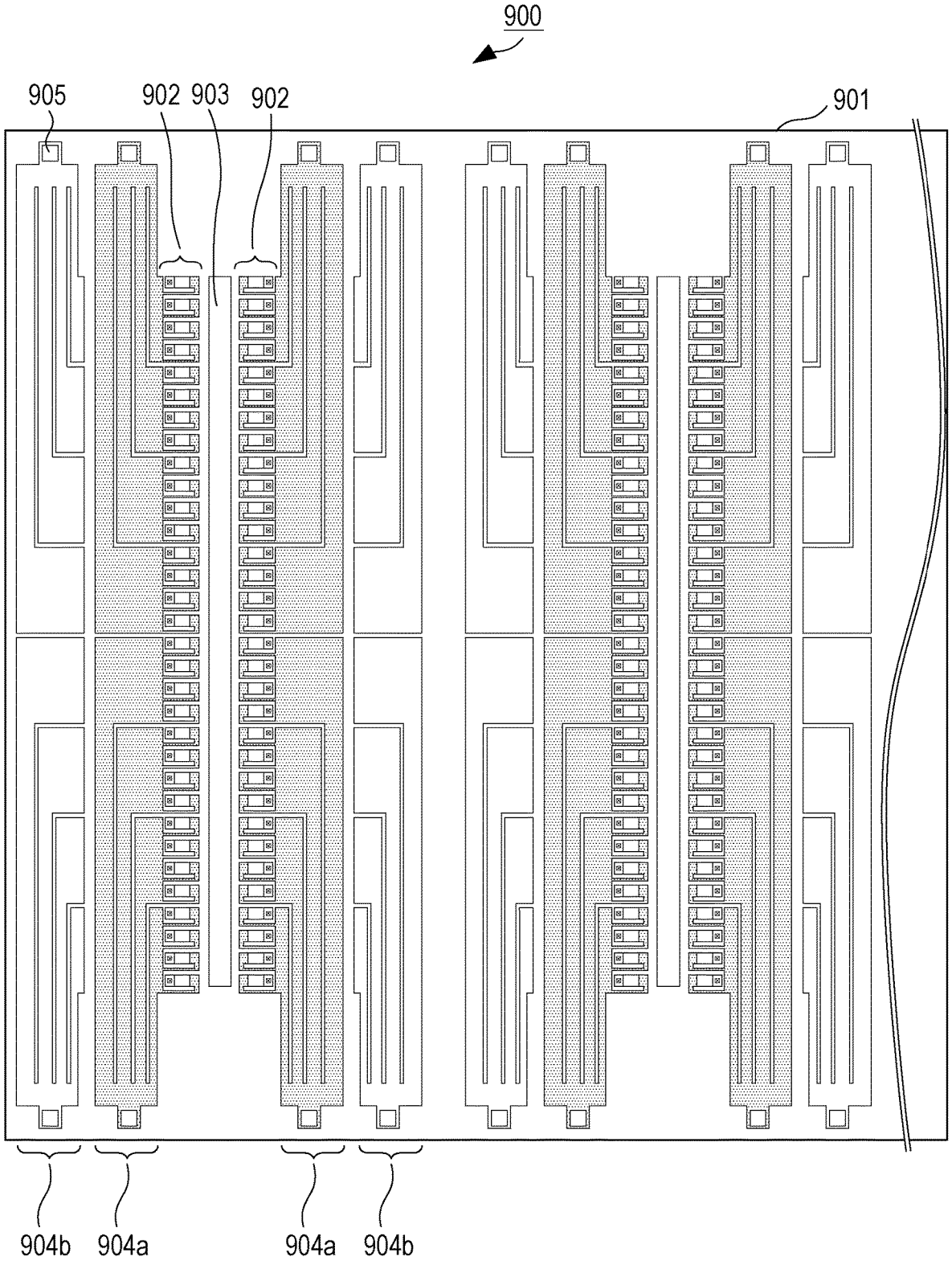
FIG. 5 illustrates the configuration of a recording element substrate according to a comparative example.

Also in this recording element substrate 400, all of the electrode pads 105 are provided along one side that is parallel to the element rows 102*a*. Therefore, when disposing a plurality of recording element substrates 400, adjacent recording element substrates 400 can be disposed close to each other. In the recording element substrate 900 of comparative example shown in FIG. 5, electrode pads 105 are provided along sides at both ends perpendicular to the element rows. Therefore, when disposing a plurality of the recording element substrates 900, they need to be disposed in a staggered manner. Compared to such an example, the recording element substrates 400 can be disposed such that sides of the recording element substrates 400 face each other, and therefore the size of a liquid ejection head having such recording element substrates 400 can be reduced. In particular, in products employing a long liquid ejection head, in order to improve the recording speed, it is effective to increase the number of energy generating elements 102 driven at the same time. For this reason, it is more preferable to apply the configuration of the present disclosure.

Although the present disclosure has been described with reference to embodiments, the present disclosure is not limited to the above embodiments. Various changes that can be understood by those skilled in the art may be made to the configuration or details of the present disclosure within the scope of the present disclosure.

For example, although, in the third and fourth embodiments, individual supply paths 103 and individual discharge paths 108 are provided on both sides of energy generating elements 102, and a liquid circulating path is thereby formed, the present disclosure is not limited to such an example. Individual supply paths 103 may be disposed on both sides of the energy generating elements 102, and liquid may be supplied from both sides of the energy generating elements 102.

For example, although, in the above fourth embodiment, a parallelogram substrate 401 is taken as an example of a substrate 401 whose adjacent sides are not at right angles to each other, the present disclosure is not limited to such an example. For example, the substrate 401 may be trapezoid in shape.

The numbers of energy generating elements 102 shown in the above embodiments are illustrative only, and various changes may be made according to design conditions.

For example, although, in each of the above embodiments, the configuration of a recording element substrate has been described, the present disclosure can also be mounted as a liquid ejection head having these recording element substrates or a liquid ejection apparatus having this liquid ejection head. A liquid ejection head having a plurality of recording element substrates described here preferably has a plurality of recording element substrates arranged on a straight line in a direction in which the element rows 102*a* extend. In this case, the plurality of recording element substrates can be disposed close to each other.

As described above, according to the present disclosure, it is possible to suppress the decrease in the power efficiency when driving energy generating elements while suppressing the increase in the substrate area accompanying the increase in the number of energy generating elements driven at the same time.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. A recording element substrate comprising:

a substrate;

a plurality of energy generating elements arranged on the substrate to form an element row;

a plurality of openings, through which liquid flows, arranged along the element row to form an opening row;

a plurality of flow paths extending, in a thickness direction of the substrate, from the plurality of openings;

a plurality of beam portions disposed between adjacent flow paths in a direction of the opening row;

a power supply conductor including a first conductor common portion and a plurality of first conductor beam portions, the first conductor common portion electrically connecting the element row, and the plurality of first conductor beam portions extending through the plurality of beam portions; and a plurality of first electrode pads electrically connected to the element row via the first conductor common portion and the plurality of first conductor beam portions and arranged along one side of the substrate that is along the element row to form an electrode pad row, wherein, in at least one of the plurality of beam portions, on a same layer as a layer where one of the plurality of first conductor beam portions is arranged, a conductor other than the one of the plurality of first conductor beam portions is not arranged, and wherein the first conductor common portion extends along the element row and the electrode pad row and the first conductor common portion is provided between the element row and the electrode pad row as viewed in a perpendicular direction perpendicular to a plane of the substrate.

2. The recording element substrate according to claim 1, further comprising:

a plurality of the opening rows including a first opening row and a second opening row, wherein, as viewed in the perpendicular direction, the element row is disposed between the first opening row and the second opening row.

3. The recording element substrate according to claim 2, further comprising:

a plurality of ejection ports for ejecting liquid supplied from the plurality of openings, wherein a plurality of first openings forming the first opening row supplies liquid to the energy generating elements and a plurality of second openings forming the second opening row discharges part of a quantity of liquid supplied from the first openings.

4. The recording element substrate according to claim 1, further comprising:

a ground conductor including a second conductor common portion and a plurality of second conductor beam portions, the second conductor common portion electrically connecting the element row, and the plurality of second conductor beam portions extending through the plurality of beam portions; and a plurality of second electrode pads electrically connected to the element row via the second conductor common portion and the plurality of second conductor beam portions and arranged along the one side of the substrate to form the electrode pad row, wherein, in at least one of the plurality of beam portions, on a same layer as a layer where one of the plurality of second conductor beam portions is arranged, a conductor other than the one of the plurality of second conductor beam portions is not arranged.

5. The recording element substrate according to claim 4, wherein the second conductor common portion extends along the element row and the electrode pad row and the second conductor common portion is provided between the electrode pad row and the element row as viewed in the perpendicular direction.

6. The recording element substrate according to claim 1, wherein one side of the substrate along a direction of the element row and a side adjacent to the one side are not at right angles to each other, and wherein the substrate is parallelogram in shape as viewed in the perpendicular direction.

7. The recording element substrate according to claim 1, wherein, within the at least one beam portion, a width of the first conductor beam portion is one-half or more of a width of the beam portion.

8. The recording element substrate according to claim 1, wherein a length of the first conductor common portion along a direction of the element row is greater than a length of the element row.

9. The recording element substrate according to claim 1, further comprising:

a plurality of the element row including a first element row and a second element row, wherein the power supply conductor includes a third conductor common portion that electrically connects the first element row and the second element row, that extends along the electrode pad row and the first element row, and that is disposed between the first element row and the second element row as viewed in the perpendicular direction.

10. The recording element substrate according to claim 1, wherein the first conductor common portion and the first conductor beam portions are contiguous.

11. The recording element substrate according to claim 4, wherein the power supply conductor and the ground conductor are stacked along a thickness direction of the substrate.

12. The recording element substrate according to claim 4, wherein the second conductor common portion and the second conductor beam portions are contiguous.

13. A liquid ejection head including a recording element substrates, the recording element substrate comprising:

a substrate;

a plurality of energy generating elements arranged on the substrate to form an element row;

a plurality of openings arranged, through which liquid flows, along the element row to form an opening row;

a plurality of flow paths extending, in a thickness direction of the substrate, from the plurality of openings;

a plurality of beam portions disposed between adjacent flow paths in a direction of the opening row;

a power supply conductor including a first conductor common portion and a plurality of first conductor beam portions, the first conductor common portion electrically connecting the element row, and the plurality of first conductor beam portions extending through the plurality of beam portions; and a plurality of first electrode pads electrically connected to the element row via the first conductor common portion and the plurality of first conductor beam portions and arranged along one side of the substrate that is along the element row to form an electrode pad row, wherein, in at least one of the plurality of beam portions, on a same layer as a layer where one of the plurality of first conductor beam portions is arranged, a conductor other than the one of the plurality of first conductor beam portions is not arranged, and wherein the first conductor common portion extends along the element row and the electrode pad row and the first conductor common portion is provided between the element row and the electrode pad row as viewed in a perpendicular direction perpendicular to a plane of the substrate.

* * * * *